US010104467B2

(12) United States Patent
Liu et al.

(10) Patent No.: US 10,104,467 B2
(45) Date of Patent: Oct. 16, 2018

(54) SPEAKER DEVICE WITH ENHANCEMENT OF BASS AND ELECTRONIC DEVICE THEREWITH

(71) Applicant: ACER INCORPORATED, New Taipei (TW)

(72) Inventors: Feng-Ming Liu, New Taipei (TW); Jia-Ren Chang, New Taipei (TW); Chih-Hsueh Huang, New Taipei (TW); Chien-Chung Chen, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 129 days.

(21) Appl. No.: 15/250,846

(22) Filed: Aug. 29, 2016

(65) Prior Publication Data

US 2017/0332167 A1 Nov. 16, 2017

(30) Foreign Application Priority Data

May 13, 2016 (TW) ..... 105114833 A

(51) Int. Cl.
*H04R 1/28* (2006.01)
*H04R 1/02* (2006.01)

(52) U.S. Cl.
CPC ..... *H04R 1/2819* (2013.01); *H04R 1/026* (2013.01); *H04R 1/2842* (2013.01); *H04R 1/2857* (2013.01); *H04R 1/2873* (2013.01); *H04R 2499/11* (2013.01); *H04R 2499/15* (2013.01)

(58) Field of Classification Search
CPC .... H04R 1/2819; H04R 1/2842; H04R 1/026; H04R 1/2857; H04R 1/2873; H04R 2499/15; H04R 2499/11; H04R 1/02; H04R 1/28; H04R 9/02; H04R 9/06; H04R 9/18; H04R 1/36; H04R 1/22; H05K 5/02; H04B 1/08
USPC ..... 381/349
See application file for complete search history.

(56) References Cited

U.S. PATENT DOCUMENTS 6,801,633 B2 * 10/2004 Tracy ..... H04R 1/345 181/141
7,556,121 B2 * 7/2009 Yang ..... H04M 1/03 181/145
7,578,367 B2 * 8/2009 Yang ..... H04R 1/2811 181/145

(Continued)

FOREIGN PATENT DOCUMENTS

CN 2629377 Y 7/2004
CN 102006531 A 4/2011
EP 2 613 563 A2 7/2013

*Primary Examiner* — Oyesola C Ojo
(74) *Attorney, Agent, or Firm* — Winston Hsu

(57) ABSTRACT

A speaker device includes a first cabinet, a speaker unit, a second cabinet and a tube cabinet. The first cabinet is disposed in a casing and with a first chamber formed therein. The speaker unit is disposed in the first chamber. The second cabinet is connected to the casing and with an opening formed on the casing. The second cabinet has a second chamber formed therein and communicating with the opening. The tube cabinet connects the first cabinet and the second cabinet. The tube cabinet has a tube chamber formed therein and communicating with the first chamber and the second chamber. A sound generated by the speaker unit is enhanced in the first chamber, transmitted to the second chamber via the tube chamber and emitted out via the opening.

16 Claims, 6 Drawing Sheets

(56) References Cited

U.S. PATENT DOCUMENTS

| | | | | |
|---|---|---|---|---|
| 7,894,620 | B2 * | 2/2011 | Yang | H04R 1/021 379/433.02 |
| 8,708,092 | B2 * | 4/2014 | Ito | H04R 1/2842 181/150 |
| 9,154,869 | B2 * | 10/2015 | Cohen | H04R 1/30 |
| 2007/0154053 | A1 * | 7/2007 | Yang | H04M 1/035 381/386 |
| 2007/0242848 | A1 * | 10/2007 | Yang | H04R 1/021 381/386 |
| 2008/0219489 | A1 | 9/2008 | Yang | |
| 2008/0219490 | A1 * | 9/2008 | Yang | H04R 1/2842 381/351 |
| 2009/0288911 | A1 * | 11/2009 | Chen | H04M 1/035 181/199 |
| 2013/0284536 | A1 * | 10/2013 | Ito | H04R 1/2842 181/156 |

* cited by examiner

SPEAKER DEVICE WITH ENHANCEMENT OF BASS AND ELECTRONIC DEVICE THEREWITH

BACKGROUND OF THE INVENTION

1. Field of the Invention

The present invention relates to a speaker device and an electronic device therewith, and more particularly, to a speaker device with enhancement of bass and an electronic device therewith.

2. Description of the Prior Art

With development of technology and advance of people's living standard, portable electronic devices, such as cell phones, tablet computers and so on, are implemented in not only work but also gaming industry, e.g., a gaming tablet is one of the products in the gaming market. Generally speaking, the gaming tablet is especially designed for facilitating handheld use and thus has constraint on volume thereof. However, the aforesaid constraint on volume of the gaming tablet further disadvantages designs of speaker and cabinet, so as to affect bass and soundstage generated by the speaker and the cabinet of the tablet computer. Accordingly, it reduces audio effect during gaming.

SUMMARY OF THE INVENTION

Thus, the present invention provides a speaker device with enhancement of bass and an electronic device therewith for solving above drawbacks.

In order to achieve the aforesaid objectives, the present invention discloses a speaker device with enhancement of bass. The speaker device is installed inside a casing of an electronic device and includes a first cabinet, a speaker unit, a second cabinet and a tube cabinet. The first cabinet is disposed in the casing, and a first chamber is formed in the first cabinet. The speaker unit is disposed in the first chamber and for emitting a sound. The second cabinet is connected to the casing and has an opening formed on the casing. A second chamber is formed in the second chamber and communicates with the opening. The tube cabinet connects the first cabinet and the second cabinet. A tube chamber is formed in the tube cabinet and communicates the first chamber and the second chamber, wherein the sound emitted from the speaker unit is enhanced in the first chamber, transmitted to the second chamber via the tube chamber and emitted out via the opening.

According to one embodiment of the present invention, the tube cabinet has an inlet and an outlet. The inlet and the outlet are respectively disposed on two opposite ends of the tube cabinet. The first chamber is communicated with the tube chamber via the inlet. The tube chamber is communicated with the second chamber via the outlet. An area of the inlet is substantially equal to an area of the outlet.

According to one embodiment of the present invention, the second cabinet has a sound stopper. The sound stopper protrudes from a side of the second cabinet and defines the opening, so that an area of the opening is between 1.5 times of an area of the outlet and 100 times of an area of the outlet.

According to one embodiment of the present invention, the sound stopper is substantially perpendicular to a normal of the outlet.

According to one embodiment of the present invention, a volume of the second chamber is smaller than half of a volume of the first chamber or the volume of the second chamber is smaller than one third of the volume of the first chamber.

According to one embodiment of the present invention, the first cabinet has a lateral wall and a top wall connected to the lateral wall. The lateral wall is parallel to a lateral portion of the casing. The top wall is parallel to a front cover of the casing. The tube cabinet is connected to the lateral wall, and the opening is formed on the lateral portion.

According to one embodiment of the present invention, the speaker device further includes a resonant cabinet combined with the lateral wall and for holding the speaker unit. The resonant cabinet, the lateral wall and the top wall cooperatively define the first chamber.

According to one embodiment of the present invention, the speaker device further includes a resonant cabinet combined with the lateral wall and for holding the speaker unit. The resonant cabinet and the first cabinet cooperatively define the first chamber.

According to one embodiment of the present invention, a resonant chamber is formed in the resonant cabinet, and the resonant cabinet resonates the sound emitted from the speaker unit.

In order to achieve the aforesaid objectives, the present invention further discloses an electronic device. The electronic device includes a casing and a speaker device installed in the casing. The speaker device includes a first cabinet, a speaker unit, a second cabinet and a tube cabinet. The first cabinet is disposed in the casing, and a first chamber is formed in the first cabinet. The speaker unit is disposed in the first chamber and for emitting a sound. The second cabinet is connected to the casing and has an opening formed on the casing. A second chamber is formed in the second chamber and communicates with the opening. The tube cabinet connects the first cabinet and the second cabinet. A tube chamber is formed in the tube cabinet and communicates the first chamber and the second chamber, wherein the sound emitted from the speaker unit is enhanced in the first chamber, transmitted to the second chamber via the tube chamber and emitted out via the opening.

In summary, the present invention utilizes the first cabinet, the second cabinet, the sound stopper, the tube cabinet, structure that the area of the inlet is substantially equal to the area of the outlet, and structures that the volume of the second cabinet is smaller than half of the volume of the first cabinet or the volume of the second chamber is smaller than one third of the volume of the first cabinet to enhance bass of the speaker device as well as to keep treble of the speaker device. Accordingly, it enhances bass of the speaker device for increasing audio effect when the electronic device is in use.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the embodiments, reference is made to the accompanying drawings which form a part hereof, and in which is shown by way of illustration specific embodiments in which the invention may be practiced. In this regard, directional terminology, such as "top," "bottom," etc., is used with reference to the orientation of the Figure(s) being described. The components of the present invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the present invention. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," and "installed" and variations thereof herein are used broadly and encompass direct and indirect connections and installations. Accordingly, the drawings and descriptions will be regarded as illustrative in nature and not as restrictive.

Figure 1:
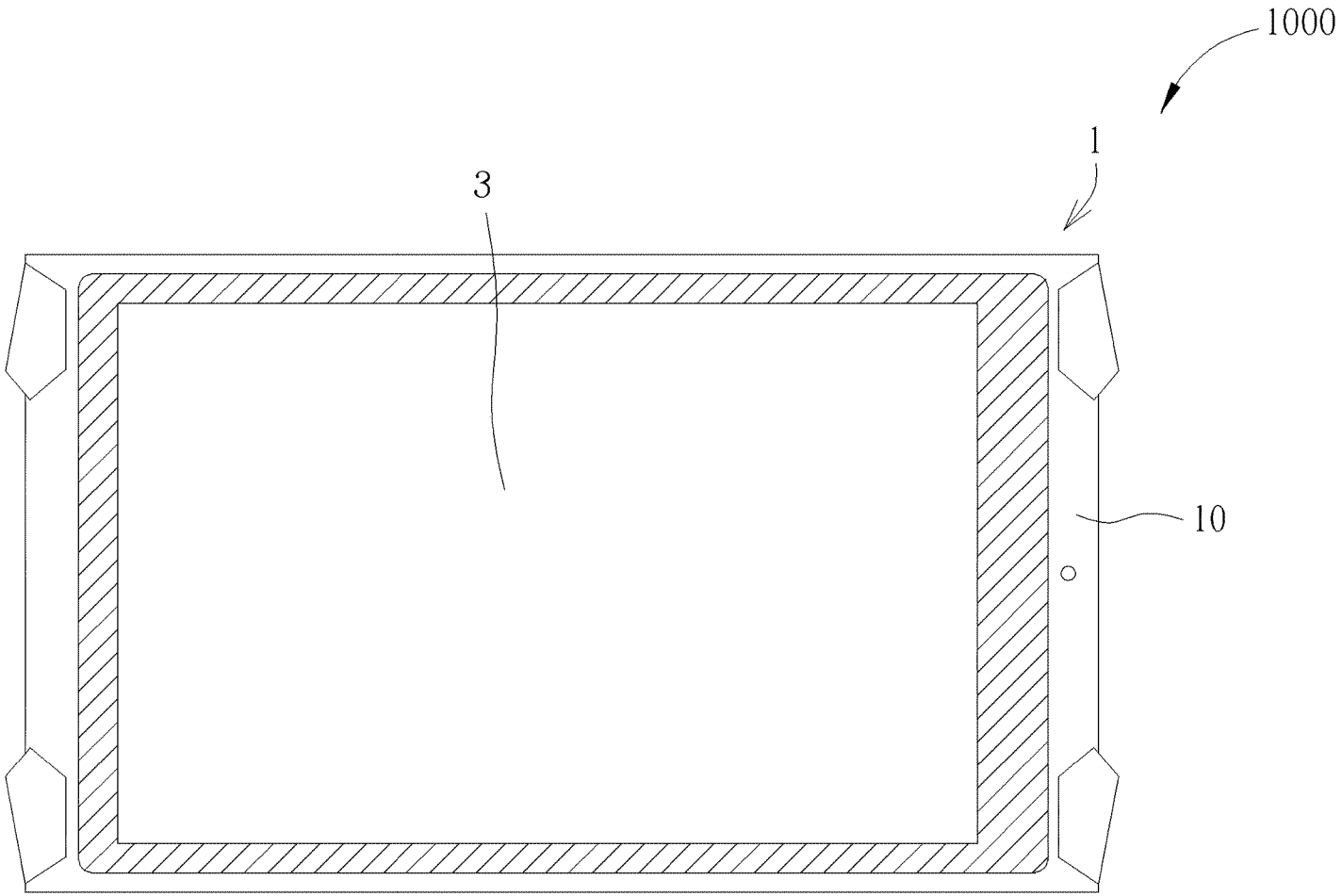
FIG. 1 is a front view of an electronic device according to an embodiment of the present invention.
Figure 2:
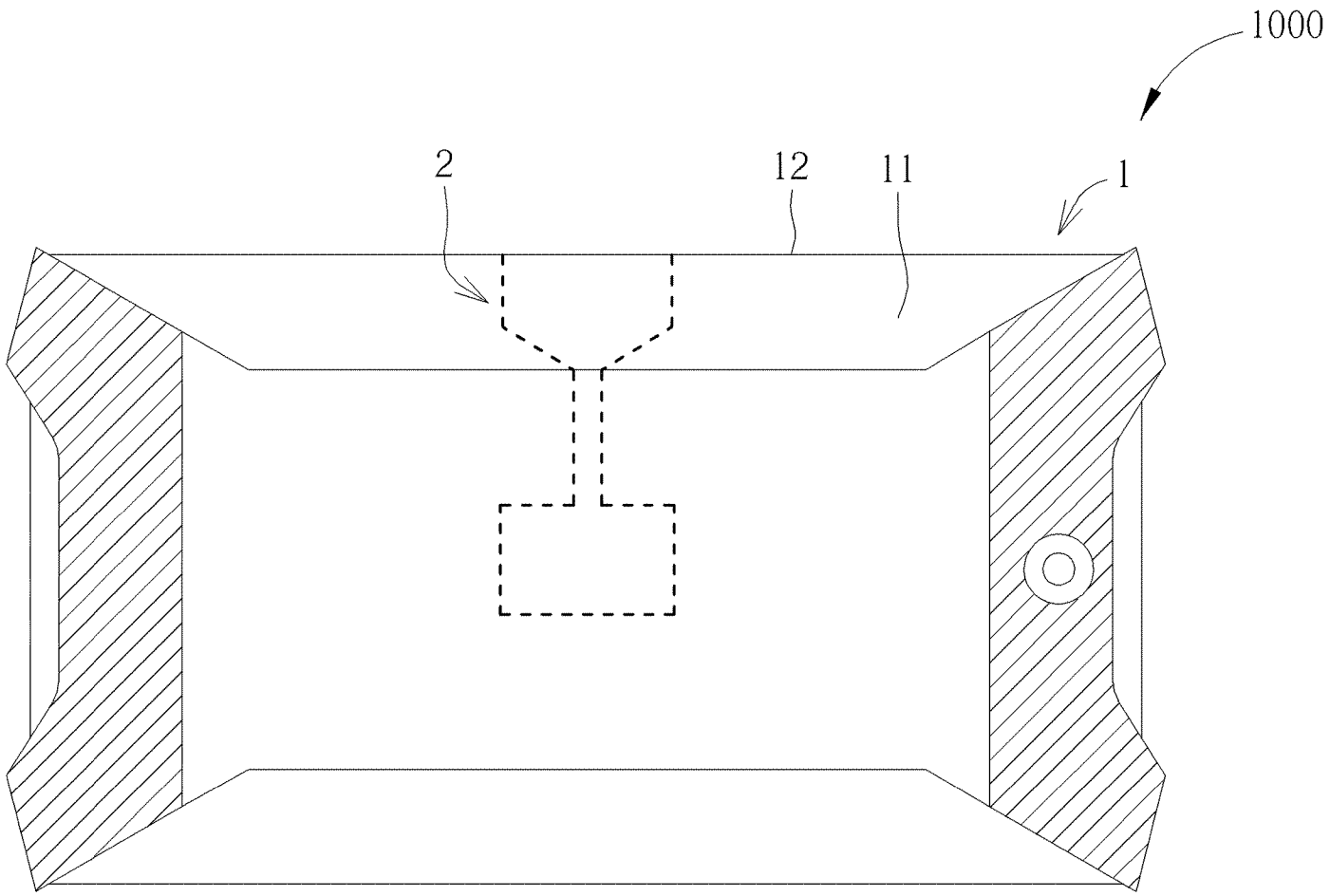
FIG. 2 is a back view of the electronic device according to the embodiment of the present invention.

FIG. 1 is a front view of an electronic device 1000 according to an embodiment of the present invention. FIG. 2 is a back view of the electronic device 1000 according to the embodiment of the present invention. As shown in FIG. 1 and FIG. 2, the electronic device 1000 includes a casing 1 and a speaker device 2. The speaker device 2 is installed in the casing 1, so that the casing 1 is able to prevent the speaker device 2 from damage due to collision. In this embodiment, the electronic device 1000 is a gaming tablet, but the present invention is not limited thereto. For example, the electronic device 1000 can be a notebook computer, an All-In-One desktop computer, a 2 in 1 tablet computer and so on. In addition, the casing 1 includes a front cover 10 and a rear cover 11. The front cover 10 and the rear cover 11 are assembled with each other, and the front cover 10 is for holding a touch control panel 3, so that a user is able to perform a touch control operation by the touch control panel 3. In this embodiment, the speaker device 2 is located in a containing space formed by the front cover 10 and the rear cover 11 and disposed on the rear cover 11, but the present invention is not limited thereto.

Figure 3:
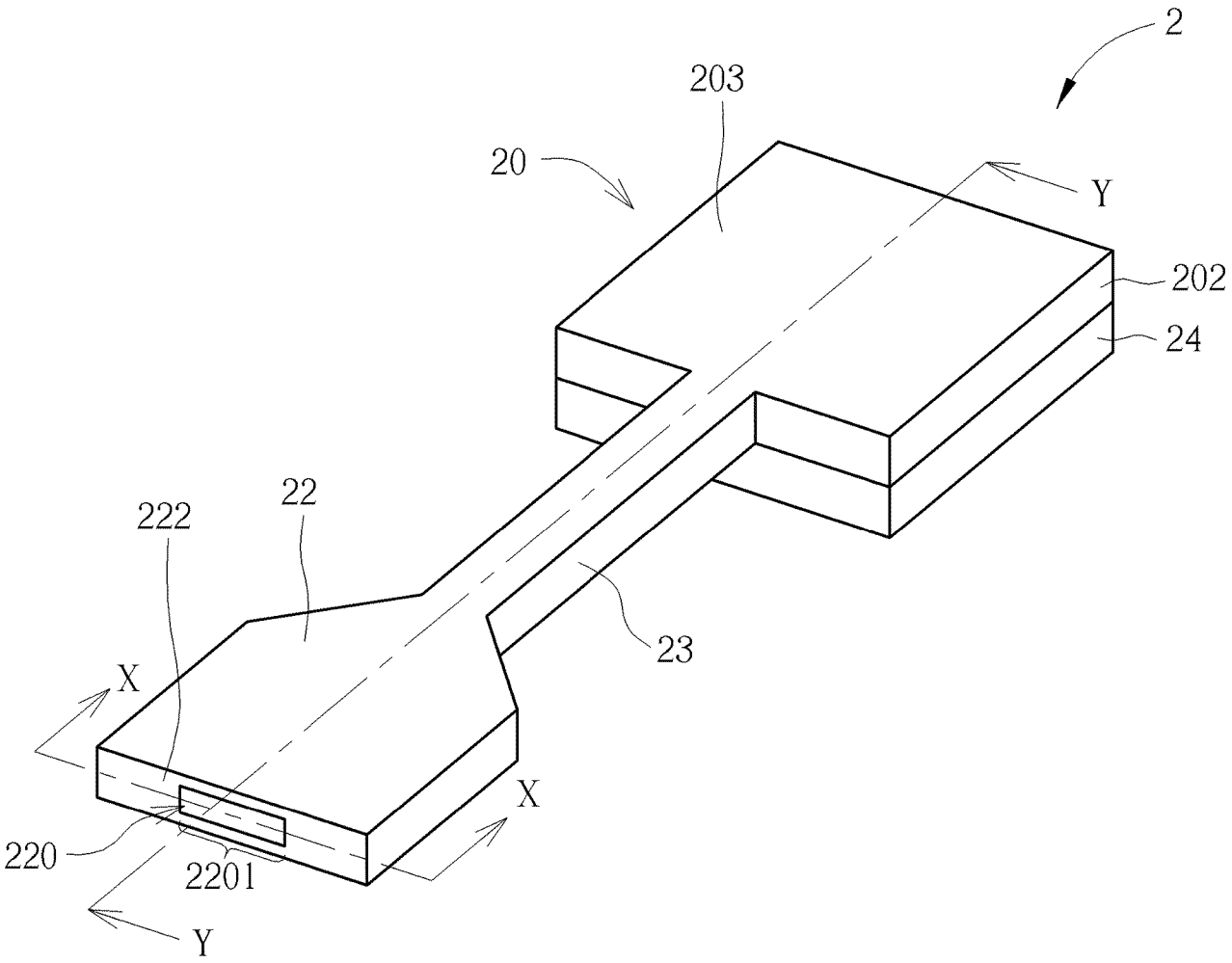
FIG. 3 is a front view of a speaker device according to the embodiment of the present invention.
Figure 4:
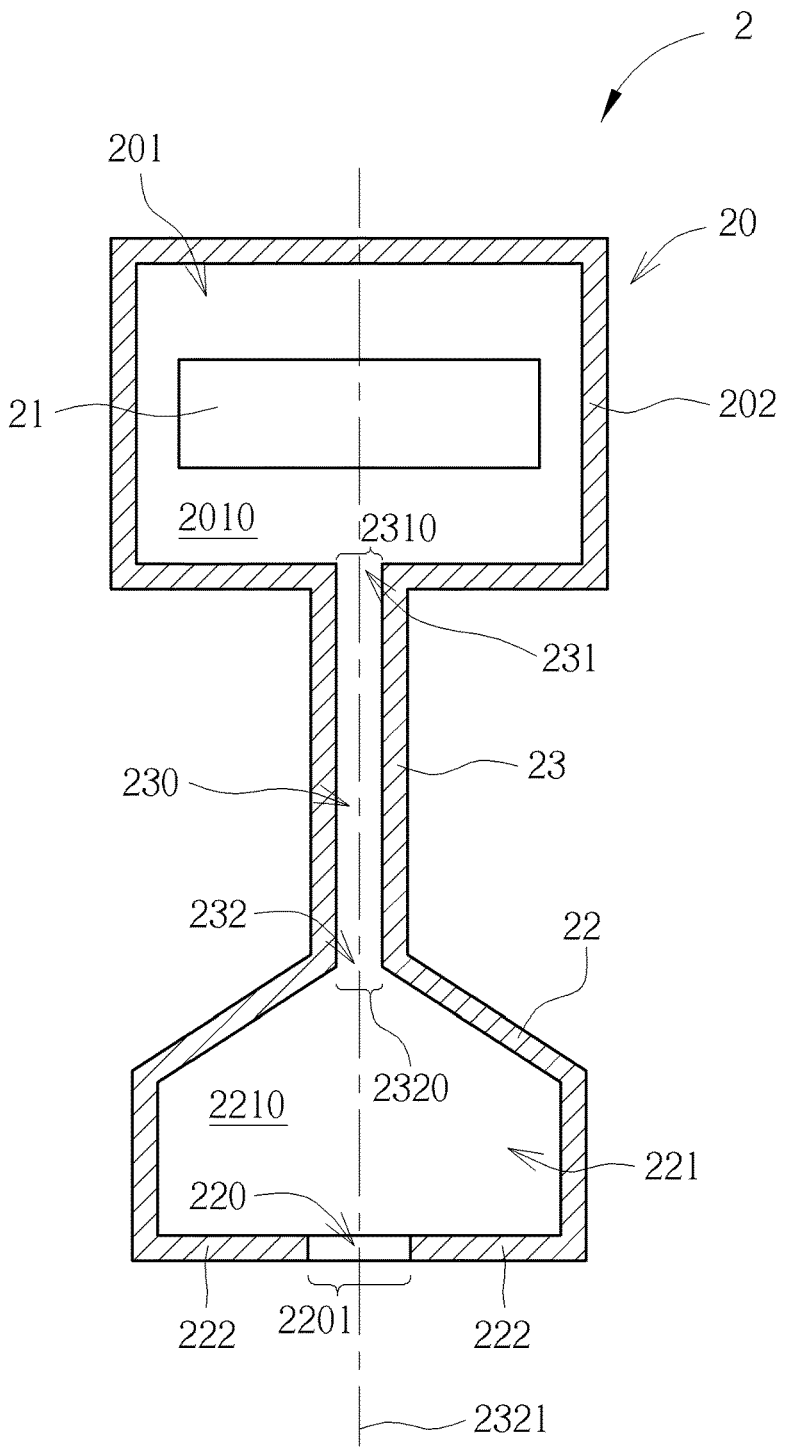
FIG. 4 is a section diagram of the speaker device along a section line X-X in FIG. 3.
Figure 5:
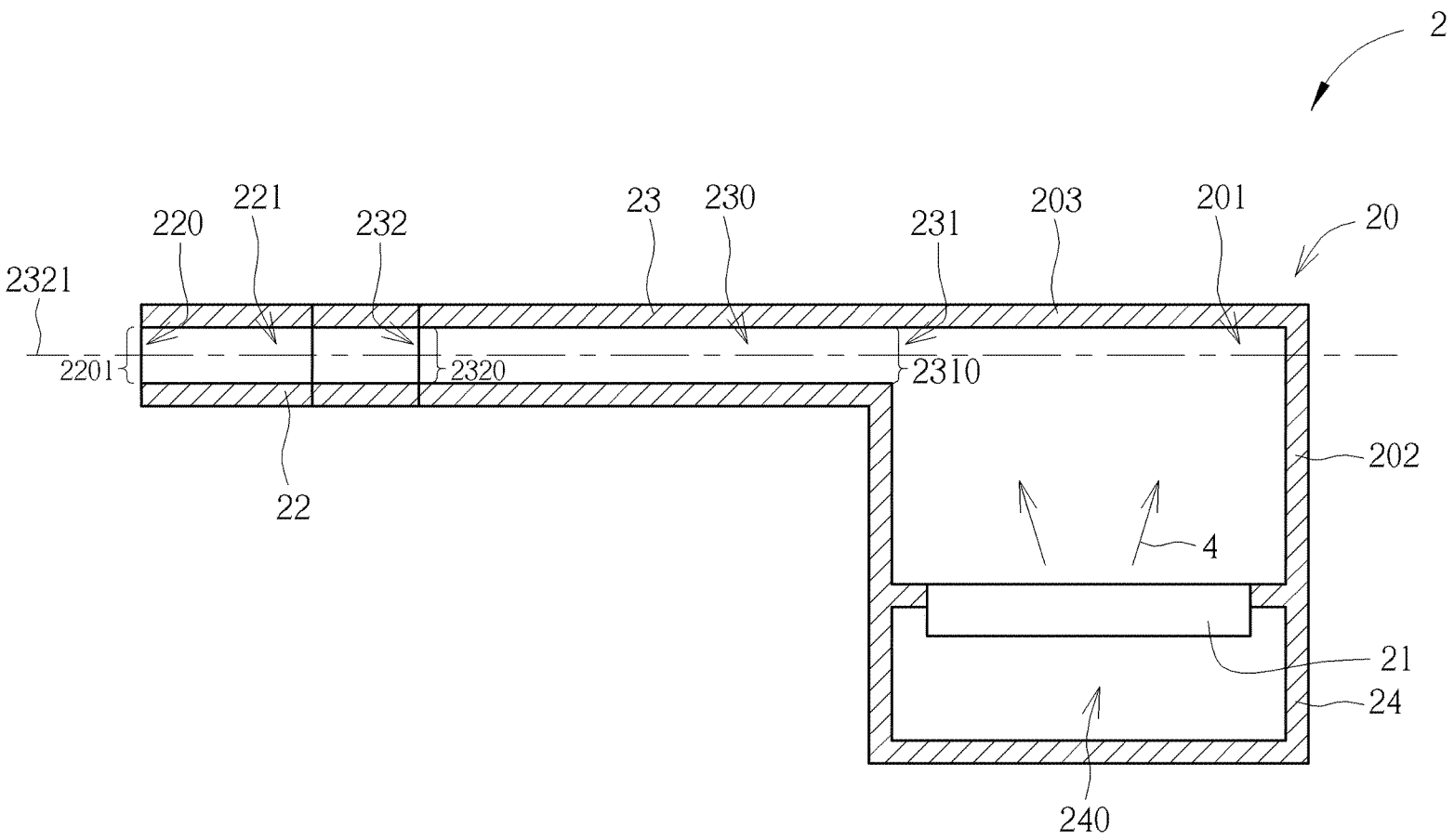
FIG. 5 is a section diagram of the speaker device along a section line Y-Y in FIG. 3.

FIG. 3 is a front view of the speaker device 2 according to the embodiment of the present invention. FIG. 4 is a section diagram of the speaker device 2 along a section line X-X in FIG. 3. FIG. 5 is a section diagram of the speaker device 2 along a section line Y-Y in FIG. 3. As shown in FIG. 3 to FIG. 5, the speaker device 2 includes a first cabinet 20, a speaker unit 21, a second cabinet 22, a tube cabinet 23 and a resonant cabinet 24. The first cabinet 20 is disposed in the casing 1. Furthermore, the first cabinet 20 has a lateral wall 202 and a top wall 203 connected to the lateral wall 202. The casing 1 further has a lateral portion 12, as shown in FIG. 2. The lateral portion 12 connects the front cover 10 and the rear cover 11. The lateral wall 202 is parallel to the lateral portion 12, and the top wall 203 is parallel to the front cover 10. A first chamber 201 is formed in the first cabinet 20. The speaker unit 21 is disposed in the first chamber 201 and for emitting a sound 4. The second cabinet 22 is connected to the casing 1 and has an opening 220 formed on the casing 1. A second chamber 221 is formed in the second cabinet 22 and communicates with the opening 220. The tube cabinet 23 connects the first cabinet 20 and the second cabinet 22. A tube chamber 230 is formed in the tube cabinet 23 and communicates the first chamber 201 and the second chamber 221.

In this embodiment, the tube cabinet 23 is connected to the lateral wall 202 of the first cabinet 20, and the opening 220 is formed on the lateral portion 12 of the casing 1, i.e., the tube cabinet 23 is extended from the lateral wall 202 of the first cabinet 20 to the lateral portion 12 of the casing 1. Furthermore, the resonant cabinet 24 is combined with the lateral wall 202 of the first cabinet 20 and for holding the speaker unit 21, so that the speaker unit 21 is located in the first chamber 201. In this embodiment, the resonant cabinet 24, the lateral wall 202 and the top wall 203 of the first cabinet 20 cooperatively define the first chamber 201. Furthermore, a resonant chamber 240 is formed in the resonant cabinet 24. When the speaker unit 21 is powered on, the sound 4 emitted from the speaker unit 21 resonates in the resonant chamber 240 and then enters the first chamber 201, i.e., the speaker unit 21 utilizes the resonant chamber 240 for emitting the sound 4.

Furthermore, the tube cabinet 23 has an inlet 231 and an outlet 232. The inlet 231 and the outlet 232 are respectively disposed on two opposite ends of the tube cabinet 23. The first chamber 201 is communicated with the tube chamber 230 via the inlet 231. The tube chamber 230 is communicated with the second chamber 221 via the outlet 232. An area 2310 of the inlet 231 is substantially equal to an area 2320 of the outlet 232, i.e., a size of the inlet 231 is substantially equal to a size of the outlet 232. Furthermore, the second cabinet 22 has a sound stopper 222. The sound stopper 222 protrudes from a side of the second cabinet 22 and extends toward a geometric center of the opening 220, so as to define a size of the opening 220. In this embodiment, the sound stopper 222 of the second cabinet 22 defines the opening 220, so that an area 2201 of the opening 220 is between 1.5 times of the area 2320 of the outlet 232 and 100 times of the area 2320 of the outlet 232. In this embodiment, the sound stopper 222 is substantially perpendicular to a normal 2321 of the outlet 232, but the present invention is not limited thereto. For example, the sound stopper 222 and the normal 2321 of the outlet 232 can be included by an acute angle, i.e., the sound stopper 222 is not perpendicular to the normal 2321 of the outlet 232, and it depends on practical demands. In this embodiment, a volume 2210 of the second chamber 221 is smaller than half of a volume 2010 of the first chamber 201, but the present invention is not limited thereto. For example, the volume 2210 of the second chamber 221 can be smaller than one third of the volume 2010 of the first chamber 201 as well, and it depends on practical demands. It should be noticed that the tube cabinet 23 of the present invention is a structure with straight orientation, but the present invention is not limited thereto. For example, the tube cabinet 23 can be a structure with curved orientation, and it depends on practical demands.

Figure 6:
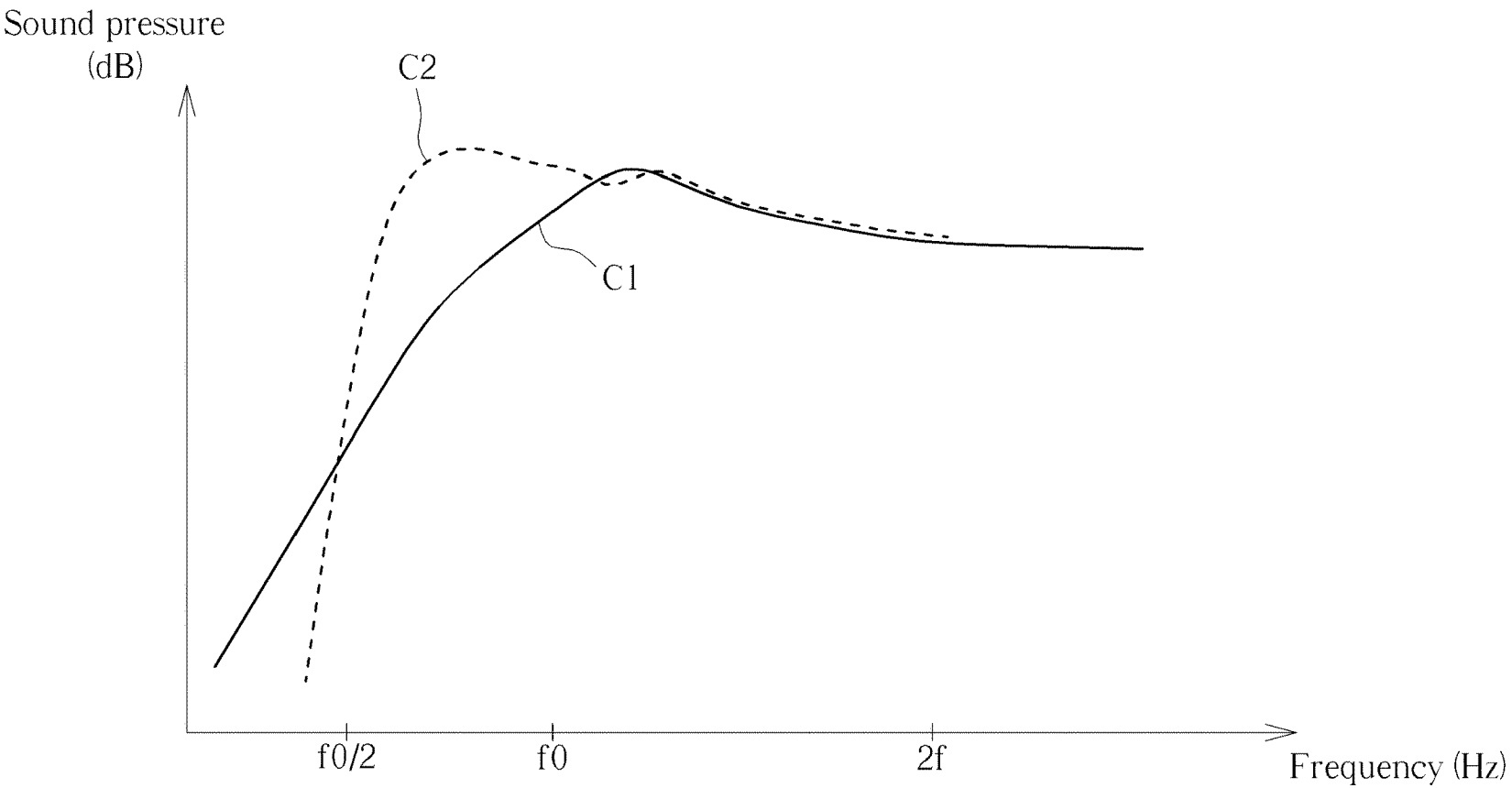
FIG. 6 is a diagram illustrating a first frequency curve corresponding to the speaker device not equipped with a second cabinet and a second frequency curve corresponding to the speaker device equipped with the second cabinet according to the embodiment of the present invention.

FIG. 6 is a diagram illustrating a first frequency curve C1 corresponding to the speaker device 2 not equipped with the second cabinet 22 and a second frequency curve C2 corresponding to the speaker device 2 equipped with the second cabinet 22 according to the embodiment of the present invention. As shown in FIG. 6, when the speaker device 2 is not equipped with the second cabinet 22 and the tube cabinet 23, the sound 4 generated by the speaker unit 21, resonated by the resonant chamber 240 and entering the first chamber 201 is emitted directly via the first cabinet 20. Meanwhile, the first frequency curve C1 corresponding to the sound 4 reaches a peak value at a resonant frequency (i.e., f0) of the speaker device 2. On the other hand, when the speaker device 2 is equipped with the second cabinet 22 and the tube cabinet 23, the sound 4 generated by the speaker unit 21, resonated by the resonant chamber 240 and entering the first chamber 201 is enhanced by the first chamber 201, transmitted to the second chamber 221 via the tube chamber 230 and emitted via the opening 220. Meanwhile, the second curve C2 corresponding to the sound 4 reaches a peak value at about half of the resonant frequency (i.e., f0/2) of the speaker device 2. Furthermore, the portion of the second curve C2 over the resonant frequency (i.e., f0) substantially matches with the portion of the first curve C1 over the resonant frequency (i.e., f0). In other words, the present invention utilizes the first cabinet 20, the second cabinet 22, the sound stopper 222, the tube cabinet 23, structure that the area 2310 of the inlet 231 is substantially equal to the area 2320 of the outlet 232, and structures that the volume 2210 of the second chamber 221 is smaller than half of the volume 2010 of the first chamber 201 or the volume 2210 of the second chamber 221 is smaller than one third of the volume 2010 of the first chamber 201 to enhance bass of the speaker device 2 as well as to keep treble of the speaker device 2.

Compared to the prior art, the present invention utilizes the first cabinet, the second cabinet, the sound stopper, the tube cabinet, structure that the area of the inlet is substantially equal to the area of the outlet, and structures that the volume of the second cabinet is smaller than half of the volume of the first cabinet or the volume of the second chamber is smaller than one third of the volume of the first cabinet to enhance bass of the speaker device as well as to keep treble of the speaker device. Accordingly, it enhances bass of the speaker device for increasing audio effect when the electronic device is in use.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A speaker device with enhancement of bass, the speaker device being installed inside a casing of an electronic device and comprising:

a first cabinet disposed in the casing, a first chamber being formed in the first cabinet;

a speaker unit disposed in the first chamber and for emitting a sound;

a second cabinet connected to the casing and having an opening formed on the casing, a second chamber being formed in the second cabinet and communicating with the opening; and a tube cabinet connecting the first cabinet and the second cabinet, a tube chamber being formed in the tube cabinet and communicating the first chamber and the second chamber, wherein the first cabinet has a lateral wall and a top wall connected to the lateral wall, the lateral wall is parallel to a lateral portion of the casing, the top wall is parallel to a front cover of the casing, the tube cabinet is connected to the lateral wall, the opening is formed on the lateral portion, the sound emitted from the speaker unit is enhanced in the first chamber, transmitted to the second chamber via the tube chamber and emitted out via the opening.

2. The speaker device of claim 1, wherein the tube cabinet has an inlet and an outlet, the inlet and the outlet are respectively disposed on two opposite ends of the tube cabinet, the first chamber is communicated with the tube chamber via the inlet, the tube chamber is communicated with the second chamber via the outlet, and an area of the inlet is substantially equal to an area of the outlet.

3. The speaker device of claim 1, wherein the second cabinet has a sound stopper, the sound stopper protrudes from a side of the second cabinet and defines the opening, so that an area of the opening is between 1.5 times of an area of the outlet and 100 times of an area of the outlet.

4. The speaker device of claim 3, wherein the sound stopper is substantially perpendicular to a normal of the outlet.

5. The speaker device of claim 1, wherein a volume of the second chamber is smaller than half of a volume of the first chamber or the volume of the second chamber is smaller than one third of the volume of the first chamber.

6. The speaker device of claim 1, further comprising:

a resonant cabinet combined with the lateral wall and for holding the speaker unit, the resonant cabinet, the lateral wall and the top wall cooperatively define the first chamber.

7. The speaker device of claim 1, further comprising:

a resonant cabinet combined with the lateral wall and for holding the speaker unit, the resonant cabinet and the first cabinet cooperatively define the first chamber.

8. The speaker device of claim 7, wherein a resonant chamber is formed in the resonant cabinet, and the resonant cabinet resonates the sound emitted from the speaker unit.

9. An electronic device, comprising:

a casing; and a speaker device installed in the casing, comprising:

a first cabinet disposed in the casing, a first chamber being formed in the first cabinet;

a speaker unit disposed in the first chamber and for emitting a sound;

a second cabinet connected to the casing and having an opening formed on the casing, a second chamber being formed in the second cabinet and communicating with the opening; and a tube cabinet connecting the first cabinet and the second cabinet, a tube chamber being formed in the tube cabinet and communicating the first chamber and the second chamber, wherein the first cabinet has a lateral wall and a top wall connected to the lateral wall, the lateral wall is parallel to a lateral portion of the casing, the top wall is parallel to a front cover of the casing, the tube cabinet is connected to the lateral wall, the opening is formed on the lateral portion, the sound emitted from the speaker unit is enhanced in the first chamber, transmitted to the second chamber via the tube chamber and emitted out via the opening.

10. The electronic device of claim 9, wherein the tube cabinet has an inlet and an outlet, the inlet and the outlet are respectively disposed on two opposite ends of the tube cabinet, the first chamber is communicated with the tube chamber via the inlet, the tube chamber is communicated with the second chamber via the outlet, and an area of the inlet is substantially equal to an area of the outlet.

11. The electronic device of claim 9, wherein the second cabinet has a sound stopper, the sound stopper protrudes from a side of the second cabinet and defines the opening, so that an area of the opening is between 1.5 times of an area of the outlet and 100 times of an area of the outlet.

12. The electronic device of claim 11, wherein the sound stopper is substantially perpendicular to a normal of the outlet.

13. The electronic device of claim 9, wherein a volume of the second chamber is smaller than half of a volume of the first chamber or the volume of the second chamber is smaller than one third of the volume of the first chamber.

14. The electronic device of claim 9, wherein the speaker device further comprises:

a resonant cabinet combined with the lateral wall and for holding the speaker unit, the resonant cabinet, the lateral wall and the top wall cooperatively define the first chamber.

15. The electronic device of claim 9, wherein the speaker device further comprises:

a resonant cabinet combined with the lateral wall and for holding the speaker unit, the resonant cabinet and the first cabinet cooperatively define the first chamber.

16. The electronic device of claim 15, wherein a resonant chamber is formed in the resonant cabinet, and the resonant cabinet resonates the sound emitted from the speaker unit.

* * * * *